US007500906B2

(12) United States Patent
Cybulski et al.

(10) Patent No.: US 7,500,906 B2
(45) Date of Patent: Mar. 10, 2009

(54) SANDING TOOL WITH ROTATABLE HANDLE

(75) Inventors: Eric R. Cybulski, Woodbury, MN (US); Ryan Patrick Simmers, Cottage Grove, MN (US); Jon A. Kirschhoffer, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/201,742

(22) Filed: Aug. 11, 2005

(65) Prior Publication Data

US 2007/0037494 A1 Feb. 15, 2007

(51) Int. Cl.
*B24B 23/00* (2006.01)

(52) U.S. Cl. ..... 451/59; 451/524; 451/354

(58) Field of Classification Search ..... 451/354, 451/523, 524, 525, 557, 522, 59, 28
See application file for complete search history.

(56) References Cited

U.S. PATENT DOCUMENTS

| | | | | | |
|---|---|---|---|---|---|
| 227,438 | A * | 5/1880 | Lothrop | 451/516 |
| 872,568 | A * | 12/1907 | Linderoth | 451/518 |
| 952,186 | A * | 3/1910 | Courtois | 451/522 |
| 3,273,192 | A * | 9/1966 | Mazzella | 15/230.11 |
| 5,168,672 | A | 12/1992 | Grégoire, Sr. | |
| 5,527,212 | A * | 6/1996 | Bowen et al. | 451/456 |
| 5,707,903 | A | 1/1998 | Schottenfeld | |
| 5,709,596 | A * | 1/1998 | Alexander et al. | 451/357 |
| 5,718,622 | A | 2/1998 | Jones | |
| 5,863,243 | A | 1/1999 | Ali | |
| 6,266,850 | B1 * | 7/2001 | Williams et al. | 16/430 |
| 6,347,985 | B1 * | 2/2002 | Loveless | 451/354 |
| 6,379,237 | B1 | 4/2002 | Gordon | |
| 6,413,157 | B1 | 7/2002 | Marton | |
| 6,454,643 | B1 | 9/2002 | Bode | |
| 6,524,175 | B2 | 2/2003 | Beaudry et al. | |
| 6,613,113 | B2 | 9/2003 | Minick et al. | |
| 6,634,937 | B1 | 10/2003 | Edwards et al. | |
| 7,101,274 | B1 * | 9/2006 | Etter et al. | 451/344 |
| 7,182,681 | B2 * | 2/2007 | Kirschhoffer et al. | 451/514 |

(Continued)

FOREIGN PATENT DOCUMENTS

| | | | | |
|---|---|---|---|---|
| FR | 988686 | * | 8/1951 | 451/522 |

(Continued)

OTHER PUBLICATIONS

U.S. Appl. No. 11/117,932; Inventors: Kirschhoffer, Jon A.; Cybulski, Eric R.; Simmers, Ryan Patrick; and Gonzalez, Bernard A.; Filing Date: Apr. 29, 2005; Total No. of pp. 16; and Total No. of sheets of Drawings: 5.

*Primary Examiner*—Robert Rose
(74) *Attorney, Agent, or Firm*—David B. Patchett

(57) ABSTRACT

A hand-held, manually-operated sanding tool including a base member, a clamping mechanism, a handle and a mounting assembly. The clamping mechanism is adapted to secure a sheet-like abrasive material to the base member. The handle includes a neck and a grip. The mounting assembly rotatably mounts the handle to the base member such that the neck extends from a top surface thereof and the handle is rotatable relative to the base member about an axis defined by the neck.

8 Claims, 4 Drawing Sheets

U.S. PATENT DOCUMENTS

| | | | |
|---|---|---|---|
| 2003/0085244 | A1 | 5/2003 | Parsons |
| 2003/0104777 | A1 | 6/2003 | Deshler |
| 2003/0121212 | A1 | 7/2003 | Minick et al. |

FOREIGN PATENT DOCUMENTS

| | | | | |
|---|---|---|---|---|
| GB | 953051 | * | 3/1964 | ..... 451/521 |
| GB | 1 247 103 | | 9/1971 | |
| WO | WO 2005/068179 | A1 | 7/2005 | |

* cited by examiner

SANDING TOOL WITH ROTATABLE HANDLE

BACKGROUND

The present invention relates generally to hand-held, manually-operated sanding tools for use with a replaceable sheet of abrasive material such as sandpaper. More particularly, it relates to sanding tools adapted to satisfy user handling preferences.

Abrasive sheets, such as conventional sandpaper, are commonly used to hand-sand or finish a work surface, such as a wooden surface. With hand-sanding, the user holds the sandpaper directly in his/her hand and then moves the sandpaper across the work surface. Sanding by hand can, of course, be an arduous task. To facilitate the hand-sanding process, the sandpaper can instead be retained by a sanding block or tool sized to fit within the user's hand. The sanding block or tool thus makes hand-sanding faster and easier. One example of a commercially-available sanding block is the 3M™ Rubber Sanding Block available from 3M Company of Saint Paul, Minn.

U.S. Pat. No. 5,168,672 describes another exemplary sanding block or tool in the form of an abrasive sheet holder having a base provided with clamping shoulders formed in a pair of opposed side edges thereof. A handle is detachably secured over a rear surface of the base. The handle has opposed flexible flange walls for clamping opposed end edge portions of an abrasive paper sheet that is otherwise positioned over a front working surface of the base, with the edge portions of the paper sheet extending over the clamping shoulders. A grip portion of the handle promotes grasping thereof within a palm of the user's hand. The grip portion is spatially fixed relative to the base. Thus, the grip portion is also spatially fixed relative to paper attached to the base.

Additionally, U.S. Patent Application Publication No. 2003/0104777 describes a sanding block or tool including a generally rectangular base housing upon which a multi-contoured, generally convex hand-grip is secured. The hand-grip further defines inwardly extending concave portions that facilitate easy and secure grasping by the user. Further, an over-center lever clamp mechanism is operative at each end of the sanding block to secure the opposed ends of a sandpaper sheet in a releasable manner. The hand-grip is ergonomic in design, and is spatially fixed relative to the base (and thus relative to sandpaper secured to the base).

As highlighted by the above, while well-accepted, known sanding blocks may have certain shortcomings. For example, it is desirable that the sanding block promote sanding in multiple directions such that the sheet of abrasive material will wear relatively evenly. This desired characteristic, in turn, means that most of the available abrasive material surface area is used before the sheet is discarded. Unfortunately, the spatially fixed handles associated with known sanding blocks do not satisfy this user preference. To the contrary, while the grip portion of known sanding block handles provide a "natural" directional orientation of the user's hand when grasping the grip portion, this directional orientation of the grip portion/user's hand relative to the abrasive material retained by the tool cannot be altered. This, in turn, dictates that sanding will primarily occur in only one or two sanding directions. In other words, the fixed grip portion promotes sanding in either an up-and-down direction or a left-to-right direction relative to the user's hand; these limited sanding directions may result in uneven wear of the abrasive material. Further, the unidirectional configuration of the known sanding block grip portion may cause distinct user discomfort over periods of extended use, such as where the natural directional orientation is contrary to the user's desired hand orientation or where the user desires to sand in multiple different directions. These concerns arise with flexible flat sheets of abrasive material, such as conventional sandpaper, as well as with resilient flexible abrasive sheets that are thicker than conventional sandpaper, such as the sheet-like abrasive materials described in, for example, Minick et al., U.S. Pat. No. 6,613,113.

U.S. Pat. No. 6,524,175 describes a pole sanding tool having a head maintaining a layer of hook-and-loop fastening material for attachment to a corresponding surface of a sanding sponge. The pole sander head further includes a universal joint for receiving an end of an elongated pole. Though pole sanding tools represent a distinct field apart from that of hand-held sanding tools, the universal joint may facilitate "swiveling" of the pole relative to the head. However, because the pole itself does not include a discernable grip portion or desired grasping orientation, the universal joint does not address rotation of a grip portion relative to the head, nor does it "lock" the pole relative to the head at multiple rotational orientations.

In light of the above, a need exists for a hand-held sanding tool that is easy to consistently load with an abrasive sheet and that provides multiple rotational orientations of a handle relative to the retained abrasive sheet to enhance user comfort.

SUMMARY

Principles of the present invention overcome the above-identified limitations in the field by providing a sanding tool that is easy to load with abrasive media and provides multiple different handle orientations. The tool is able to accommodate different types, widths, and thicknesses of sheet-like abrasive material. In addition, the tool is simple to operate, requiring no special auxiliary tools, and is designed to be easy to manufacture and assembled.

Aspects in accordance with principles of the present invention relate to a hand-held, manually-operated sanding tool for use with a replaceable sheet-like abrasive material. The sanding tool includes a base member, a clamping mechanism, a handle and a mounting assembly. The base member defines a top surface and a bottom surface. The clamping mechanism is adapted to selectively retain at least a portion of a sheet-like abrasive material to the base member such that the sheet of abrasive material extends across the bottom surface. The handle includes a neck and a grip. With this in mind, the mounting assembly rotatably mounts the handle to the base member. More particularly, the mounting assembly is configured such that the neck extends from the top surface and the handle is rotatable relative to the base member about an axis defined by the neck. With this configuration, the handle can be rotatated to different rotational orientations relative to the base member, and thus relative to the sheet-like abrasive material secured to the base member. Thus, a user can select a desired handle orientation preferred for a particular sanding operation. In one embodiment, the mounting assembly is further adapted to selectively lock the handle relative to the base member at a plurality of rotational orientations. In other embodiments, the mounting assembly includes first and second sets of ridges that interface with one another to selectively lock the handle relative to the base at a desired rotational orientation Other aspects in accordance with the principles of the present invention relate to a method of sanding with a hand-held, manually-operated sanding tool. The method includes providing a sanding tool including a base member, a clamping mechanism, a handle and a mounting assembly. The base member defines a top surface and a bottom surface. The clamping mechanism is associated with the base member. The handle includes a neck and a grip, and is rotatably mounted to the base member by the mounting assembly. In particular, the neck extends from the top surface and the handle is rotatable relative to the base member about an axis defined by the neck. A sheet of abrasive material is also provided and is secured to the base member via the clamping mechanism such that the sheet extends across the bottom surface. The handle is rotated to a desired rotational orientation of the grip relative to the base member. A user grasps the grip within the user's hand. The sheet of abrasive material is maneuvered across a working surface by applying a force to the handle via the user's hand. This action, in turn, sands the working surface. In one embodiment, the handle is locked relative to the base member in the desired rotational orientation.

DETAILED DESCRIPTION

Figure 1:
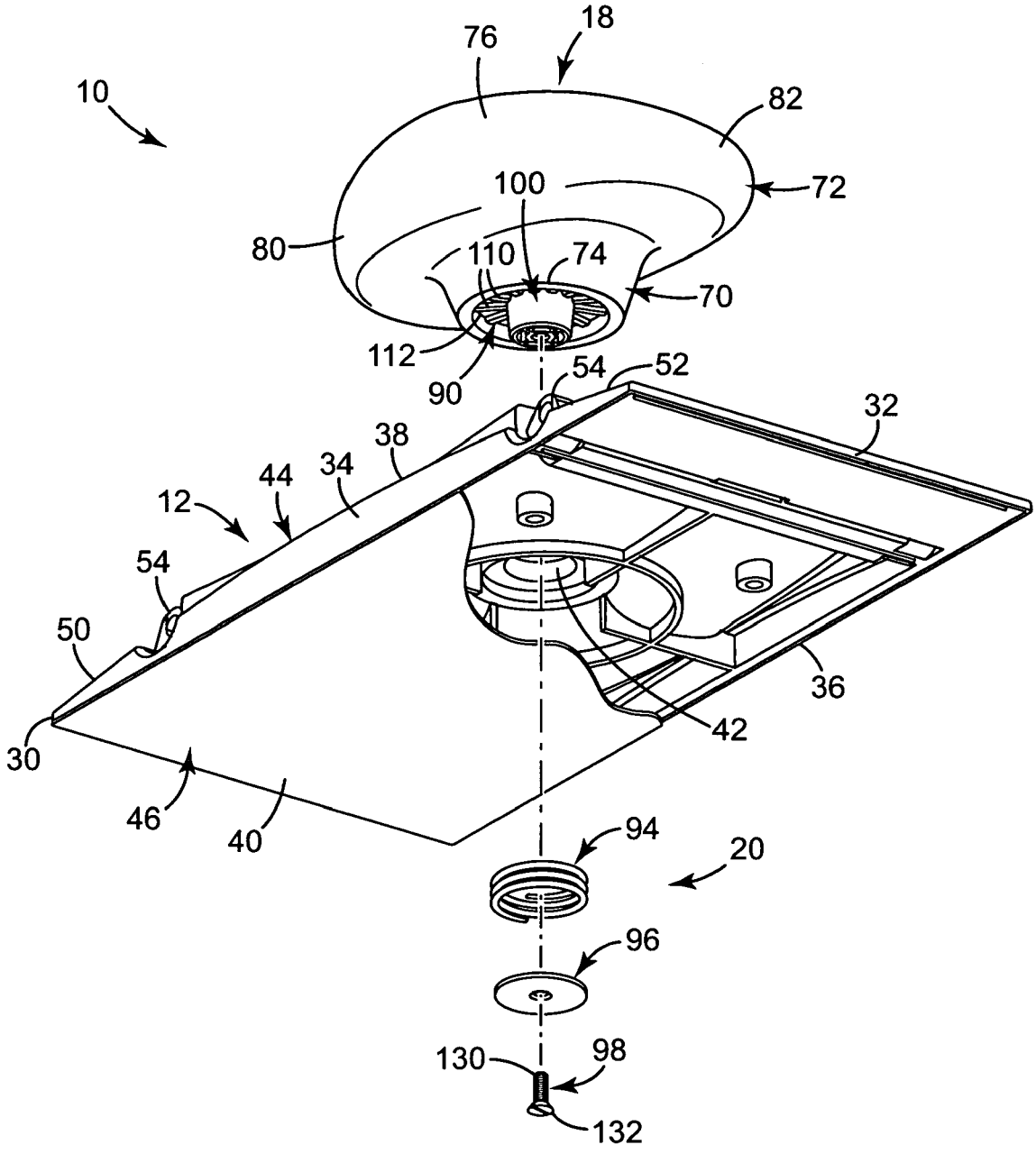
FIG. 1 is a bottom perspective, exploded view of a hand-held, manually-operated sanding tool according to principles of the present invention.
Figure 2:
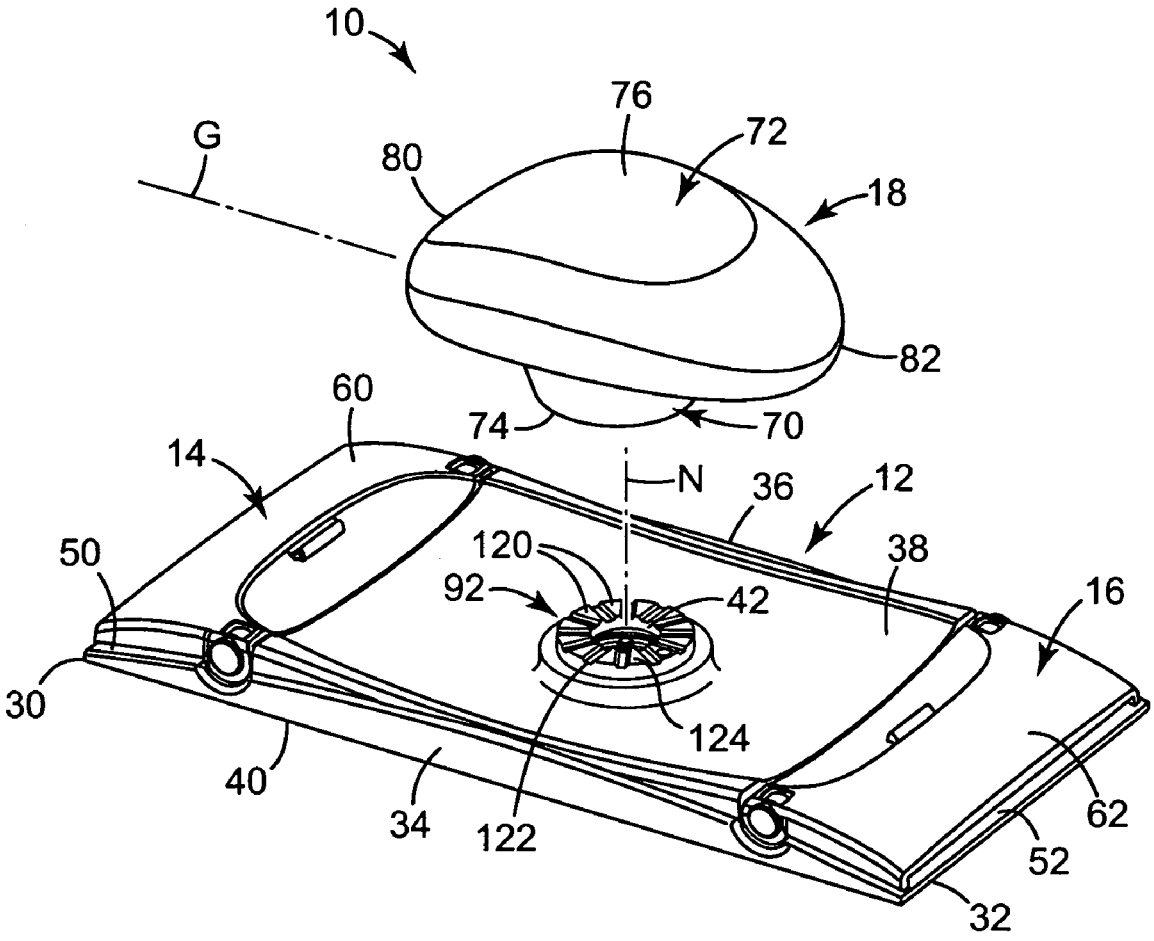
FIG. 2 is a top perspective, exploded view of the sanding tool of FIG. 1.

One embodiment of a hand-held, manually-operated sanding tool or sanding block 10 is shown in exploded form in FIGS. 1 and 2. The term "manually-operated" refers to the fact that the tool 10 is not a power tool. That is, all of the power for the tool 10 is provided by a user (not shown), and the tool 10 itself does not include a motor. It will be recognized, however, that principles of the present invention may be applied to a power tool and are not necessarily limited to manually-operated sanding tools.

The sanding tool 10 is described below as being useful with sheet-like abrasive material. As used throughout this specification, the terms "sheet-like abrasive material" and "sheet of abrasive material" are used interchangeably and refer to thin, flexible, generally square or rectangular sheets of abrasive material having discrete ends that can be attached to a sanding block. Such sheet-like abrasive material include, for example, conventional sandpaper, flexible sanding scrims, non-woven abrasive materials such as Scotch-Brite™ available from 3M Company, St. Paul, Minn., and thin flexible abrasive sheet materials such as those described in U.S. Pat. No. 6,613,113 (Minick et al.), the entire contents of which are hereby incorporated by reference. The tool 10 may also find use with non-abrasive sheet-like materials such as dust removing tack cloths. However, the terms "sheet-like abrasive material" and "sheet of abrasive material" do not include so-called endless belts of abrasive material commonly used with power sanding tools, die cut sheets that are commonly sold pre-cut to match the size and shape of a particular sanding tool as is commonly done for power detail sanding tools, or abrasive sheets having their own attachment means, such as adhesive or hook-and-loop fasteners, that independently facilitate attachment to a tool.

With the above in mind, in one embodiment, the sanding tool 10 includes a base member 12, first and second clamping mechanisms 14, 16 (shown in FIG. 2), a handle 18, and a mounting assembly 20 (referenced generally in FIG. 1). For ease of illustration, the clamping mechanisms 14, 16 are not shown in FIG. 1. As made clear below, the base member 12 and the clamping mechanism(s) 14 and/or 16 can assume a wide variety of forms apart from that shown in FIGS. 1 and 2 in accordance with principles of the present invention. Regardless, and in general terms, the first and second clamping mechanisms 14, 16 are pivotally associated with opposing ends, respectively, of the base member 12. The handle 18 is rotatably coupled to the base member 12 by the mounting assembly 20. With this configuration, the handle 18 can be moved to a variety of different rotational orientations relative to the base member 12 (and thus relative to a sheet-like abrasive material (not shown) secured to the base member 12 via the clamping mechanisms 14, 16) as desired by a user.

In one embodiment, the base member 12 defines first and second opposed ends 30, 32, first and second opposed sides 34, 36, a top surface 38, and a generally planar bottom surface 40 against which a sheet of abrasive material (not shown) is secured. While the base member 12 is illustrated in FIG. 1 as having a generally rectangular shape, a variety of other shapes can be provided that lend themselves for use with conventional sheet-like abrasive materials. For example, the base member 12 can be configured such that one or both of the first and second ends 30, 32 define a triangular or curved shape. Further, the first and second ends 30, 32 need not be identical in shape.

As described below, the base member 12 is, in one embodiment, adapted to form a portion of the mounting assembly 20. In more general terms, however, the base member 12 forms an aperture 42 (best shown in FIG. 2) adapted to facilitate assembly to the handle 18. The aperture 42 extends from, and is open relative to, the top surface 38. Depending upon an exact construction of the base member 12, the aperture 42 can also extend to the bottom surface 40. However, as best shown in FIG. 1, in one embodiment the base member 12 is formed by a base body 44 and a support body 46. The base body 44 defines the top surface 38 and the aperture 42. The support body 46 is separately formed and assembled to the base body 44, and is comprised of a material amenable for supporting a sheet-like abrasive material (not shown), such as a foam pad. Regardless, the support body 46 defines the bottom surface 40 and extends across the aperture 42, such that the aperture 42 is covered relative to the bottom surface 40 with the one embodiment of FIG. 1.

Further details of the base member 12 provided below relate to optional features that are not necessarily required by aspects of the present invention. With this in mind, in one embodiment, regardless of an overall shape, the top surface 38 forms a first upper contact surface 50 (referenced generally) opposite the bottom surface 40 and extending from the first end 30. A second upper contact surface 52 (referenced generally) is similarly formed opposite the bottom surface 40, extending from the second end 32. In one embodiment, the upper contact surfaces 50, 52 are angled or inclined. In this manner, the upper contact surfaces 50, 52 and the bottom surface 40 form an acute angle relative to the associated end 30, 32, respectively. Alternatively, the first and/or second contact surfaces 50 and/or 52 need not be identical and need not necessarily be angled or inclined relative to the bottom surface 40.

In one embodiment the base member 12 is configured to facilitate pivoting attachment thereto by the first and second clamping mechanisms 14, 16. For example, the base member 12 forms posts 54 (two of which are shown in FIG. 1) as extensions from the top surface 38 adjacent the first contact surface 50 and the second contact surface 52, respectively. The posts 54 are configured to receive a corresponding component associated with the first and second clamping mechanisms 14, 16 in a manner allowing for pivoting movement of the clamping mechanisms 14, 16 relative to the posts 54. A wide variety of other structure(s) and/or mechanisms can be provided for pivotally connecting the clamping mechanisms 14, 16 to the base member 12. Even further, where the clamping mechanisms 14, 16 are of a conventional form, the posts 54 can be eliminated.

The first and second clamping mechanisms 14, 16 can also assume a wide variety of forms. In one embodiment, the clamping mechanisms 14, 16 include a pivoting member 60, 62, respectively, each maintaining a gripping surface (not shown). Details on acceptable constructions of the clamping mechanisms 14, 16 are provided, for example, in U.S. patent application Ser. No. 11/117,932, filed Apr. 29, 2005 and entitled "Sanding Tool", the teachings of which are incorporated herein in its entirety. In general terms, the pivoting members 60, 62 are each pivotally secured to the base member 12 (such as via the posts 54) so as to be moveable between a closed position (illustrated in FIG. 2) and an open position in which the pivoting member 60, 62, and thus the gripping surface, is pivoted away from the corresponding upper contact surface 50, 52 to establish a gap in which a sheet-like abrasive material (not shown) is received. Subsequently, in the closed position, the clamping mechanism 14, 16 frictionally secures the sheet-like abrasive material to the corresponding upper contact surface 50, 52. With this one construction, a desired tension is readily established across the sheet-like abrasive material that otherwise extends along the bottom surface 40. Alternatively, one or both of the first and/or second clamping mechanisms 14 and/or 16 can be replaced with a conventional mechanism for securing a sheet of abrasive material (not shown) to the tool 10.

The handle 18 can also assume a variety of forms, and generally includes a neck 70 and a grip 72. The neck 70 forms a leading end 74, with the grip 72 extending from the neck 70 opposite the leading end 74. The grip 72 is configured to form a grip surface 76 adapted to facilitate ergonomic grasping thereof within a user's hand (not shown). For example, with the one embodiment of FIGS. 1 and 2, the grip surface 76 has a contoured, elongated ball-like shape that readily nests within the palm of a human hand. This elongated configuration can be defined by a number of different shapes, and general includes a leading side 80 and a trailing side 82. The grip surface 76 tapers in width from the leading side 80 to the trailing side 82 to define a natural grasping orientation in which a user's thumb and index finger (not shown) naturally reside at the leading side 80, and the user's palm (not shown) rests on or at the trailing side 82. Of course, a user may prefer to hold the grip surface 76 in a number of different manners and the grip 72 can assume a wide variety of differing shapes. Regardless, and as best shown in FIG. 2, the grip surface 76 generally defines a gripping direction having an axis G; again, the gripping direction/axis G relates to an expected orientation of the user's hand while naturally grasping the grip surface 76 in a fashion encouraged by a shape of the grip surface 76.

Notably, the gripping direction/axis G is defined apart from the neck 70. That is to say, the neck 70 generally extends from the grip 72 in a direction displaced from the gripping direction/axis G for reasons made clear below. To this end, extension of the neck 70 defines a central neck axis N (FIG. 2) that is not otherwise aligned with the gripping direction/axis G. In one embodiment, the neck axis N and the gripping direction/axis G are substantially perpendicular to one another.

The mounting assembly 20 includes, in one embodiment, a first set of ridges 90, a second set of ridges 92 (FIG. 2), a biasing device 94, a bearing body 96, a capturing device 98, and a post 100. Details on the various components are provided below. In general terms, however, the first set of ridges 90 are associated with the handle 18, whereas the second set of ridges 92 are associated with the base member 12. The biasing device 94 biases the first and second set of ridges 90, 92 into engagement with one another via interface with the bearing body 96 and the base member12. The capturing device 98 retains the bearing body 96 relative to the biasing device 94, as well as the handle 18 relative to the base member 12. Finally, the post 100 is coaxially received within the aperture 42 for aligning the handle 18 relative to the base member 12. With this construction, the mounting assembly 20 allows for rotation of the handle 18 relative to the base member 12 and provides for a plurality of rotational orientation positions in which the handle 18 is "locked" relative to the base member 12.

The first and second sets of ridges 90, 92 are correspondingly constructed to mesh with one another upon final assembly. With this in mind, in one embodiment, the first set of ridges 90 is integrally formed at the leading end 74 of the neck 70, and includes a plurality of circumferentially arranged ridges 110, adjacent ones of which are separated by a gap 112 (one of which is identified in FIG. 1). Each of the ridges 110 has an approximately identical height, such that each of the gaps 112 defines an approximately identical depth. Further, in one embodiment, the ridges 110 are uniformly spaced. Any number of the ridges 110 can be provided; in one embodiment, however, at least four of the ridges 110 are formed, more preferably at least eight of the ridges 110 are formed, even more preferably at least ten.

With specific reference to FIG. 2, the second set of ridges 92 is, in one embodiment, integrally formed by the base member 12 at the top surface 38 thereof. The second set of ridges 92 includes a plurality of ridges 120 circumferentially arranged around the aperture 42, with adjacent ones of the ridges 120 being separated by a groove 122 (one of which is identified in FIG. 2). Each of the ridges 120 has an approximately identical height, such that each of the grooves 122 has an approximately identical depth. As compared to a nominal height of the ridges 110 of the first set 90, however, the ridges 120 of the second set 92 have an increased nominal height. Thus, a nominal depth of the grooves 122 is greater than a nominal height of the ridges 110. Further, each of the grooves 122 has a width slightly greater than a nominal width of the ridges 110. With this one embodiment then, upon final assembly, each of the ridges 120 of the second set 92 fully nest within a corresponding one of the gaps 112, whereas each of the ridges 110 of the first set 90 only partially extend or nest within a corresponding one of the grooves 122. In one embodiment, to facilitate selective disengagement of the ridges 120 from the gaps 112, the ridges 120 terminate in a slightly tapering end 124 (referenced generally in FIG. 2). Alternatively, the first and/or second set of ridges 90 and/or 92 can assume other forms capable of facilitating a selectively locked relationship.

In one embodiment, the biasing device 94 is a compression spring sized to be coaxially disposed about the post 100. The bearing body 96 is a washer body having an inner diameter less than that defined by the spring 94 such that upon final assembly, the bearing body 96 abuts, or bears against, the spring 94. Finally, the capturing device 98 is, in one embodiment, a screw, bolt or similar device sized to extend through the bearing body 96, having a first end 130 adapted for engagement with the neck 70 (e.g., threaded engagement) and a second end 132 sized to abut the bearing body 96. Alternatively, the biasing device 94, the bearing body 96 and/or the capturing device 98 can assume a wide variety of other forms adapted to assemble the handle 18 to the base member 12 in a manner biasing the first and second sets of ridges 90, 92 into engagement with one another. For example, in one alternative embodiment, the biasing device 94, the bearing body 96, and the capturing device 98 are replaced by a compression washer otherwise mountable to the post 100.

Finally, the post 100 is, in one embodiment, formed as an extension from the neck 70 in a direction of the neck axis N (FIG. 2). The post 100 is sized to be coaxially received within the aperture 42, and serves to generally align the handle 18 relative to the base member 12 and in particular the aperture 42. Alternatively, the post 100 can assume a variety of other forms, and in some embodiments is eliminated.

Assembly of the handle 18 to the base member 12 via the mounting assembly 20 in accordance with one embodiment is substantially as follows. The neck 70 is positioned over the base member 12 such that the post 100 is aligned with the aperture 42. The neck 70 is directed toward the base member 12 such that the post 100 extends through the aperture 42, and the first and second sets of ridges 90, 92 interface (e.g., mesh) with one another as described above. The spring 94 is disposed about the post 100 opposite the top surface 38, such that a side of the spring 94 bears against the base member 12. The bearing body 96 is placed against the spring 94 opposite the base member 12, and the capturing device 98 is inserted through the bearing body 96 and into engagement with the handle 18. More particularly, as the second end 132 of the capturing device 98 is drawn toward the handle 18, the second end 132 imparts a force on to the bearing body 96. This force is transposed on to the biasing device 94 that is otherwise compressed between the bearing body 96 and the base member 12. The biasing device 94 resists the compressive force, such that the mounting assembly 20 biases the first and second sets of ridges 90, 92 into engagement with one another.

Figure 3:
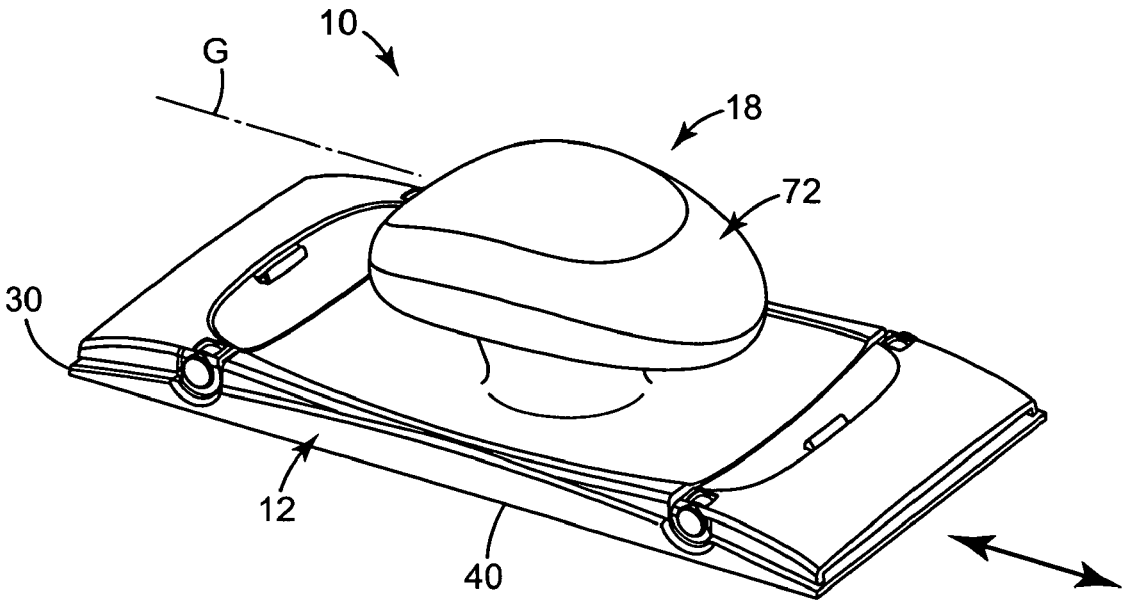
FIG. 3 is a top perspective view of the sanding tool of FIG. 1 with a handle in a first rotational orientation.
Figure 4:
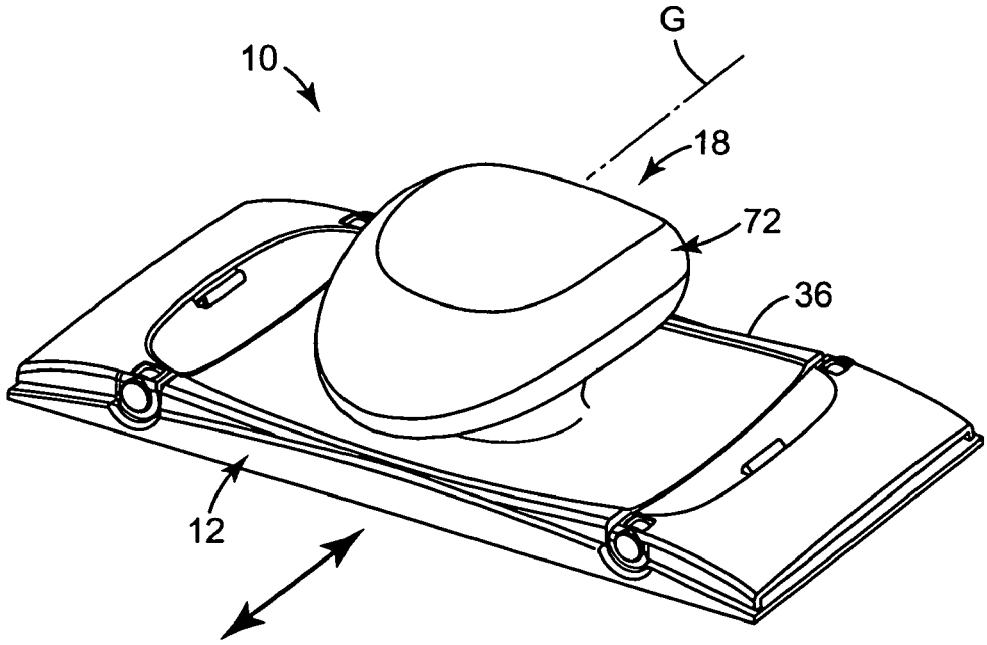
FIG. 4 is a top perspective view of the sanding tool of FIG. 1 with the handle in a second rotational orientation.

Once assembled, the biased, meshed interface between the sets of ridges 90, 92 effectively "locks" the handle 18 in a rotational orientation relative to the base member 12. One such rotational orientation is shown in FIG. 3. More particularly, the handle 18 is rotationally oriented such that the gripping direction/axis G is spatially oriented in a direction of the first end 30 of the base member 12. In this position, a user (not shown) can grasp the grip 72 in his/her hand and perform a sanding operation in which a sheet-like abrasive material (not shown), otherwise secured to the base member 12 and extending along the bottom surface 40, is maneuvered across a working surface to effectuate sanding of the working surface by placement of manual force upon the handle 18. The rotational orientation of the handle 18 in FIG. 3 can, for example, be highly conducive to sanding in a longitudinal direction of the base member 12 (shown by an arrow in FIG. 3).

Where desired, a second rotational orientation of the handle 18 relative to the base member 12 can subsequently be selected. In particular, the handle 18 is rotated relative to the base member 12 about the neck axis N (FIG. 2), resulting, for example, in the rotational handle orientation shown in FIG. 4. To this end, a rotational or moment force can be applied by a user (not shown) on to the grip 72 to effectuate rotation of the handle 18 relative to the base member 12. Returning to FIGS. 1 and 2, as the rotational force is imparted on to the handle 18 (relative to the base member 12), the first set of ridges 90 are forced to disengage from the second set of ridges 92 (i.e., the ridges 110 of the first set 90 dislodge from the corresponding grooves 122, and the ridges 120 of the second set 92 dislodge from the gaps 112, with each ridge 110 effective sliding up and over a corresponding, adjacent of the ridges 120). The tapered end 124 of the ridges 120 facilitates this disengagement, while interface between the post 100 and the aperture 42 maintains axial alignment between the handle 18 and the base member 12 in the disengaged state of the sets of ridges 90, 92. In addition, the user can apply a pulling force on to the handle 18 and the base member 12 sufficient to cause the sets of ridges 90, 92 (FIGS. 1 and 2) to slightly axially separate from one another, thus making rotational disengagement of the sets of ridges 90, 92 easier.

Regardless, once the handle 18 is rotated to a desired rotational orientation, the sets of ridges 90, 92 again mesh with one another, to effectively "lock" the handle 18 relative to the base member 12 in the selected rotational position. That is to say, rotation of the handle 18 relative to the base member 12 continues until the ridges 110 of the first set 90 are again axially aligned with respective ones of the grooves 122 (and the ridges 120 of the second set 92 are aligned with respective ones of the gaps 112). Once aligned, the mounting assembly 20 biases the sets of ridges 90, 92 into meshed engagement. This rotational process is continued/repeated until a desired rotational orientation of the handle 18 relative to the base member 12 is achieved. For example, with the second rotational orientation of FIG. 4, the gripping direction/axis G is spatially oriented in a direction of the second side 36 of the base member 12. This orientation can be conducive, for example, to sanding in a transverse direction of the base member 12 (shown by an arrow in FIG. 4). It will be understood that the available number of "locked" rotational orientations is a function of the number of ridges 110, 120 (FIGS. 1 and 2) provided. Notably, the mounting assembly 20 can assume a number of other configurations that promote rotation of the handle 18 along with, in some embodiments, locking of the handle 18 relative to the base member 12. For example, an end of the neck 18 can form a multi-sided shape (e.g., hexagonal) with the base member 12 forming a similarly shaped aperture; a biasing device biases the neck end into selective engagement with the aperture, with a user being able to overcome this biased engagement to rotate the handle relative to the base member.

Figure 5:
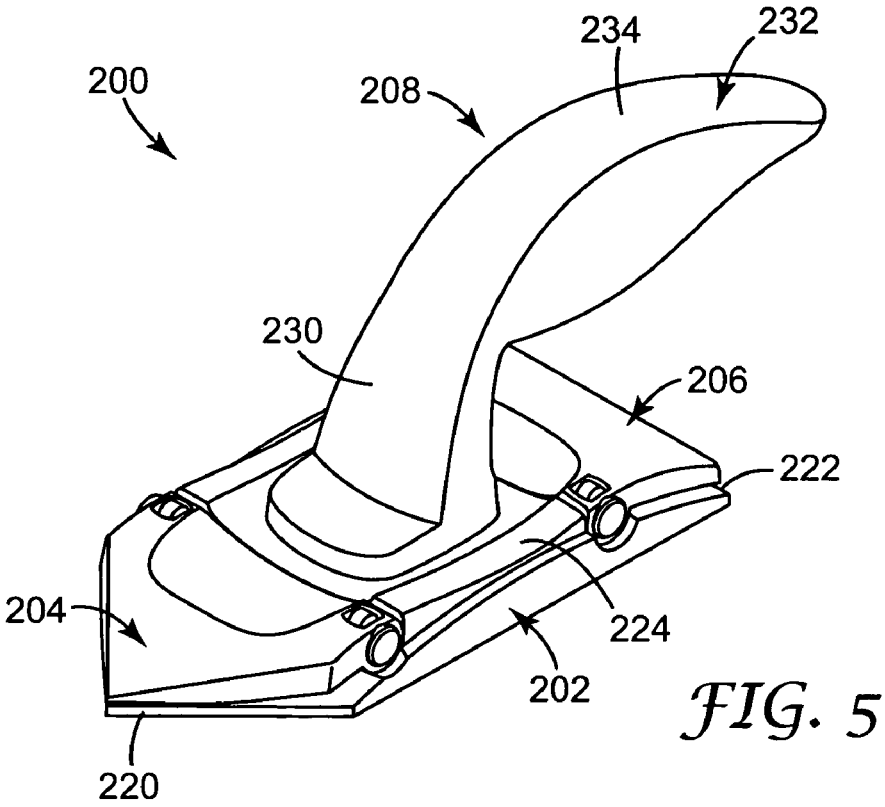
FIG. 5 is a top perspective view of another embodiment hand-held, manually-operated sanding tool according to principles of the present invention, including a handle in a first rotational orientation.
Figure 6:
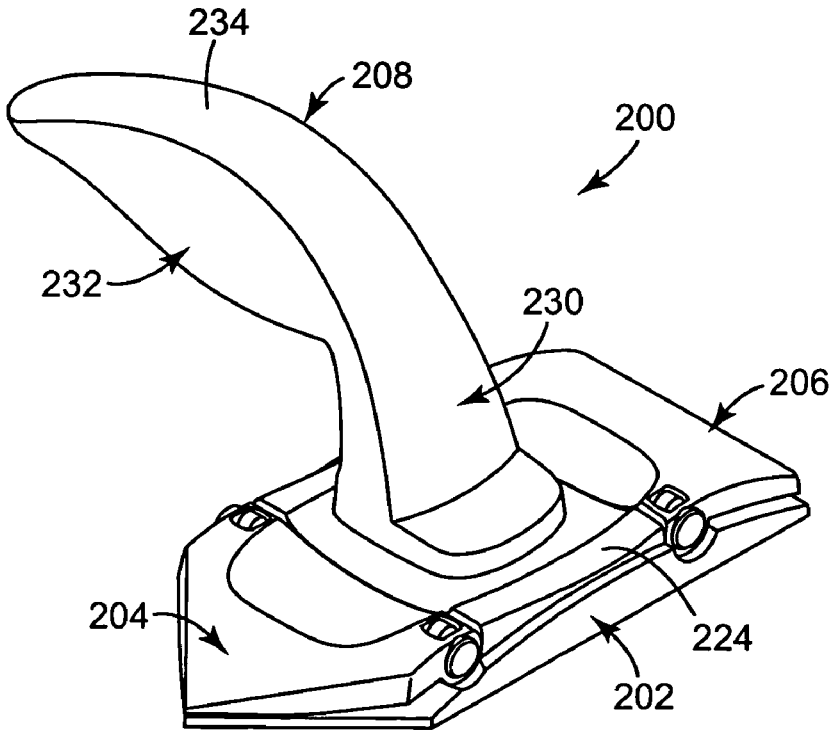
FIG. 6 is a top perspective view of the sanding tool of FIG. 5 with the handle in a second rotational orientation.

The sanding tool 10 described above is but one example of an acceptable configuration in accordance with principles of the present invention. For example, an alternative embodiment sanding tool 200 is shown in FIGS. 5 and 6. In basic terms, the sanding tool 200 is highly similar to the sanding tool 10 previously described, and includes a base member 202, clamping mechanisms 204, 206, and a handle 208. The sanding tool 200 further includes a mounting assembly that is hidden in the views of FIGS. 5 and 6, but can assume any of the forms previously described with respect to the mounting assembly 20 (FIGS. 1 and 2). Thus, the mounting assembly rotatably mounts the handle 208 to the base member 202.

With the above general principles in mind, the base member 202 defines first and second ends 220, 222, and a top surface 224. Unlike the base member 12 (FIGS. 1 and 2), with the embodiment of FIGS. 5 and 6, the first and second ends 220, 222 are not identical; the first end 220 has a triangular shape. The first clamping mechanism 204, while generally similar to the clamping mechanisms 14, 16 (FIGS. 1 and 2) previously described, mimics this triangular shape.

The handle 208 again includes a neck 230 and a grip 232, with the grip 232 having a grip surface 234 defining a gripping direction/axis G. A comparison of the handle 208 with the handle 18 (FIGS. 1 and 2) illustrates the wide variety of handle shapes available with the present invention.

The mounting assembly (not shown) rotatably mounts the neck 230 to the top surface 224, preferably in a manner that selectively "locks" the handle 208 relative to the base member 202 at a plurality of rotational orientations of the gripping direction/axis G relative to the base member 202. For example, FIG. 5 illustrates a first rotational orientation, whereas FIG. 6 illustrates a second, different rotational orientation.

The sanding tool in accordance with principles of the present invention provides a marked improvement over previous designs. In particular, by providing the sanding tool with a rotatable handle, a user can select, and re-select, an ergonomically-desired rotational orientation of the handle for any particular use. Further, and in accordance with some embodiments, the ability to selectively lock the handle at a desired rotational orientation ensures that an adequate pushing force can be applied by the user.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A hand-held, manually-operated sanding tool for use with a replaceable sheet-like abrasive material, the sanding tool comprising:

a base member defining a top surface and a bottom surface;

a clamping mechanism adapted to selectively retain at least a portion of a sheet-like abrasive material to the base member such that the sheet-like abrasive material extends across the bottom surface;

a handle including a neck and a grip; and a mounting assembly rotatably mounting the handle to the base member such that the neck extends from the top surface and the handle is rotatable relative to the base member about an axis defined by the neck, wherein the mounting assembly includes:

a first set of ridges associated with the handle;

a second set of ridges associated with the base member; and a biasing device for biasing the first set of ridges into engagement with the second set of ridges;

wherein adjacent ridges of the first set of ridges are separated by grooves, wherein individual ridges of the second set of ridges are sized to nest within respective ones of the grooves, and wherein a nominal height of the first set of ridges is less than a nominal height of the second set of ridges.

2. The sanding tool of claim 1, wherein each ridge of the second set of ridges terminates in a tapered leading end.

3. The sanding tool of claim 1, wherein the mounting assembly further includes:

an aperture formed in the base member; and a post extending through the aperture and connected to the handle.

4. The sanding tool of claim 3, wherein the biasing device is a spring coaxially disposed about the post and bearing against the base member opposite the handle.

5. The sanding tool of claim 4, wherein the mounting assembly further includes a washer body bearing against the spring opposite the base member.

6. A method of sanding with a hand-held, manually-operated sanding tool, the method comprising:

providing a sanding tool including:

a base member defining a top surface, a bottom surface, first and second ends, and first and second sides, a clamping mechanism associated with the base member, a handle including a neck and a grip, a mounting assembly rotatably mounting the handle to the base member such that the neck extends from the top surface and the handle is rotatable relative to the base member about an axis defined by the neck, the mounting assembly configured to constantly apply a biasing force that biases the handle toward the base member;

providing a replaceable sheet-like abrasive material;

securing the sheet-like abrasive material to the base member via the clamping mechanism such that the sheet-like abrasive material extends across the bottom surface;

rotating the handle to a rotationally and axially locked state in a first desired rotational orientation of the grip relative to the base member, wherein the biasing force is continuously applied by the mounting assembly while the handle is rotated;

a user grasping the grip within a user's hand; and maneuvering the sheet-like abrasive material across a working surface by applying a force to the handle via the user's hand to sand the working surface.

7. The method of claim 6, further comprising:

rotating the handle to a second desired rotational orientation differing from the first desired rotational orientation; and sanding the working surface with the handle in the second desired rotational orientation.

8. A hand-held, manually-operated sanding tool for use with a replaceable sheet-like abrasive material, the sanding tool comprising:

a base member defining a top surface and a bottom surface;

a clamping mechanism adapted to selectively retain at least a portion of a sheet-like abrasive material to the base member such that the sheet-like abrasive material extends across the bottom surface;

a handle including a neck and a grip; and a mounting assembly rotatably mounting the handle to the base member such that the neck extends from the top surface and the handle is rotatable relative to the base member about an axis defined by the neck, wherein the mounting assembly includes:

a first set of ridges associated with the handle;

a second set of ridges associated with the base member; and a biasing device for biasing the first set of ridges into engagement with the second set of ridges;

wherein each ridge of the second set of ridges terminates in a tapering leading end.

* * * * *